US011933053B2

(12) United States Patent
Jansen van Vuuren et al.

(10) Patent No.: US 11,933,053 B2
(45) Date of Patent: Mar. 19, 2024

(54) CLADDING ATTACHMENT DEVICES, SYSTEMS, AND ASSOCIATED METHODS OF USE

(71) Applicant: 0776425 B.C. LTD., Abbotsford (CA)

(72) Inventors: Stefanus H. Jansen van Vuuren, Chilliwack (CA); Michael D. Heppell, Abbotsford (CA); Aaron C. Fraser, Chilliwack (CA)

(73) Assignee: 0776425 B.C. LTD., Abbotsford (CA)

( * ) Notice: Subject to any disclaimer, the term of this patent is extended or adjusted under 35 U.S.C. 154(b) by 18 days.

(21) Appl. No.: 17/704,898

(22) Filed: Mar. 25, 2022

(65) Prior Publication Data

US 2023/0304295 A1 Sep. 28, 2023

(51) Int. Cl.

| | |
|---|---|
| ***E04C 2/38*** | (2006.01) |
| ***E04B 1/38*** | (2006.01) |
| ***E04B 1/76*** | (2006.01) |
| ***E04F 13/08*** | (2006.01) |

(52) U.S. Cl.

CPC ..... *E04F 13/0805* (2013.01); *E04B 1/388* (2023.08); *E04B 1/7637* (2013.01)

(58) Field of Classification Search

CPC ..... E04F 13/0805; E04B 1/388; E04B 1/7637

See application file for complete search history.

(56) References Cited

U.S. PATENT DOCUMENTS

| | | | | |
|---|---|---|---|---|
| 336,414 A | | 2/1886 | Kerr | |
| 3,251,168 A | * | 5/1966 | Waring | E04F 19/065 52/235 |
| 3,308,588 A | * | 3/1967 | Von Wedel | E06B 1/38 52/204.591 |
| 3,453,795 A | * | 7/1969 | Heirich | E04F 13/0805 52/506.08 |
| 3,467,418 A | | 9/1969 | Reddit | |

(Continued)

FOREIGN PATENT DOCUMENTS

| | | |
|---|---|---|
| EP | 2918746 A2 | 9/2015 |
| EP | 2918746 | 1/2017 |
| WO | 2008101319 A1 | 8/2008 |

OTHER PUBLICATIONS

RDH Building Engineering Ltd., RDH Building Sciences Inc., and Rockwool Inc., "Cladding Attachment Solutions for Exterior Insulated Commercial Walls," Graham et al., Dec. 2015, 20 pages.

(Continued)

*Primary Examiner* — Basil S Katcheves

(74) *Attorney, Agent, or Firm* — Perkins Coie LLP

(57) ABSTRACT

Devices, systems, and associated methods for attaching materials girts, rails, cladding, and/or other cladding components to an exterior wall portion (e.g., an insulated exterior wall portion) or other substructure of a building are disclosed herein. In some embodiments, the system includes cladding component attachment devices and cladding anchors, each configured to extend between the exterior wall portion and the cladding component. Each cladding anchor can have a base configured to be attached to the exterior wall of the building and a rod attached to the base and projecting outwardly therefrom and having a distal end portion configured to be attached to the cladding component. One or more of the cladding anchors can be positioned between adjacent cladding component attachment devices.

39 Claims, 7 Drawing Sheets

(56) References Cited

U.S. PATENT DOCUMENTS 3,507,082 A * 4/1970 Heirich ..... E04F 13/0812 248/222.51
3,513,613 A * 5/1970 Reid ..... E04B 9/26 52/762
3,626,650 A * 12/1971 Lickliter et al. .... E04F 13/0803 52/762
3,667,183 A * 6/1972 Heirich ..... E04F 13/0805 52/464
3,972,168 A * 8/1976 Allen ..... E04B 1/4114 52/713
4,111,096 A 9/1978 Fasth
4,438,611 A * 3/1984 Bryant ..... E04F 19/06 52/410
4,553,366 A * 11/1985 Guerin ..... E04F 13/0805 52/506.08
4,765,108 A * 8/1988 Lapish ..... E04B 2/96 248/231.91
4,844,648 A 7/1989 Fentiman
5,118,069 A * 6/1992 Muhlethaler ..... F16F 3/0873 248/68.1
5,144,780 A 9/1992 Gieling et al.
5,347,781 A 9/1994 Hanlon
5,590,974 A 1/1997 Yang
5,605,410 A 2/1997 Pantev
5,820,289 A 10/1998 Kern et al.
5,997,117 A 12/1999 Krietzman
6,029,954 A 2/2000 Murdaca
6,398,193 B1 6/2002 Desouza
6,886,790 B2 * 5/2005 Soyris ..... F16M 11/043 248/300
6,948,704 B2 9/2005 Forbis et al.
7,427,055 B2 9/2008 Platt
7,562,504 B2 * 7/2009 Herbst ..... E04F 13/0889 52/762
8,429,866 B2 4/2013 Knight et al.
8,726,583 B2 5/2014 Verdecia et al.
8,739,483 B1 * 6/2014 Bilge ..... E04F 13/0858 52/235
8,875,467 B2 11/2014 Anastasi
9,366,055 B1 6/2016 Wright
9,499,974 B2 * 11/2016 Bombino ..... E04B 2/58
9,605,425 B1 3/2017 Hendry
9,783,992 B2 * 10/2017 Bombino ..... E04B 1/388
10,206,506 B1 2/2019 Lai et al.
10,316,508 B1 6/2019 Hendry
D939,106 S 12/2021 Styrc
2003/0205009 A1 * 11/2003 Herbst ..... E04F 13/0805 52/235
2005/0193680 A1 9/2005 Wang
2005/0241250 A1 * 11/2005 Tarr ..... E02D 31/02 52/266
2006/0179762 A1 * 8/2006 Thome ..... E04F 13/0805 52/506.01
2007/0022683 A1 * 2/2007 McGee ..... E04F 13/0805 52/270
2008/0017780 A1 * 1/2008 Downey ..... F16F 15/08 248/610
2009/0145071 A1 * 6/2009 Radford ..... E04F 19/061 52/506.08
2010/0031597 A1 * 2/2010 Baek ..... F16B 37/045 52/489.1
2010/0325997 A1 * 12/2010 Scully ..... E04F 13/0805 52/489.1
2011/0000160 A1 * 1/2011 Sarayli ..... E04F 13/0805 52/475.1
2011/0185659 A1 * 8/2011 Lorenz ..... E04F 13/0805 52/302.1
2012/0137610 A1 6/2012 Knight et al.
2012/0174516 A1 * 7/2012 Mann ..... E04F 13/0733 52/475.1
2012/0297725 A1 11/2012 Anastasi
2013/0074431 A1 * 3/2013 Croasdale ..... E04B 1/7604 52/309.4
2013/0174506 A1 * 7/2013 Bombino ..... E04B 1/388 52/750
2013/0291465 A1 * 11/2013 Resso ..... E04F 13/007 52/302.1
2013/0306808 A1 11/2013 Huang
2013/0312352 A1 * 11/2013 Gale ..... E04C 2/46 52/582.1
2014/0075855 A1 * 3/2014 Hohmann, Jr. ..... E04F 13/0805 52/562
2014/0083042 A1 3/2014 Hiragaki
2014/0305063 A1 * 10/2014 Kim ..... E04F 13/0814 52/745.1
2015/0128518 A1 5/2015 Knight et al.
2016/0289977 A1 10/2016 Lucchese
2017/0233996 A1 8/2017 Abernathy et al.
2018/0094426 A1 * 4/2018 Winter ..... E04F 11/1817
2018/0187411 A1 7/2018 Shang
2018/0202143 A1 * 7/2018 Vanker ..... E04F 11/022
2018/0223526 A1 8/2018 Schillinger
2018/0320362 A1 11/2018 Wheatley
2023/0069389 A1 3/2023 Jansen van Vuuren et al.

OTHER PUBLICATIONS

Rockwool Group, "Cladding Attachment Solutions For Exterior Insulated Commercial Walls, " RDH Building Engineering Ltd. and RDH Building Sciences Inc., Graham et al., Dec. 2017, 16 pages.
Armatherm Z Girt Structural Thermal Break Cladding Attachment (https://www.armatherm.com/thermal-break-materials/armatherm-z-girt/), last accessed Jun. 17, 2022, 6 pages.
Eco Cladding, Cladding Systems, (https://www.ecocladding.com/systems), last accessed Jan. 18, 2022, 7 pages.
ISO Clip, Thermal Clip For Exterior Wall Assemblies (https://isoclips.com/), May 4, 2021, 12 pages.
TCLIP™ Building Envelope System (https://www.engineeredassemblies.com/en/systems/tclip%E2%84%A2-thermally-broken-facade-structure), Engineered Assemblies Inc., last accessed Jan. 18, 2022, 2 pages.
Nvelope, NH2 System Horizontal Cladding Attachment, (https://www.nvelope.com/cladding-systems-NH2-horizontal-cladding.php), last accessed Jan. 18, 2022, 4 pages.
ACS Composite Systems, Inc., Thermal Break Wall Systems, (http://acscompositesystems.com/thermal-wall-break-systems/), last accessed Jan. 18, 2022.
SMARTci Systems, SMARTci GreenGirt Clip, (https://smartcisystems.com/products/smartci-greengirt-clips/), last accessed Jan. 18, 2022, 3 pages.
International Search Report and Written Opinion received for counterpart International Application No. PCT/CA2023/050369 dated May 26, 2023 (7 pages).
International Search Report and Written Opinion for PCT International Patent Application No. PCT/CA2022/051191, 12 pages.

* cited by examiner

CLADDING ATTACHMENT DEVICES, SYSTEMS, AND ASSOCIATED METHODS OF USE

TECHNICAL FIELD

The present disclosure is generally related to devices, systems, and associated methods for attaching cladding and/or other materials to building structures.

BACKGROUND

The construction and operation of buildings accounts for a significant portion of global energy-related carbon emissions. In recent years, there has been a focus on energy efficiency and the construction of better-insulated buildings. There are various ways of insulating the exterior walls of a building, and some of the most efficient methods include the use of "continuous" insulation with minimal thermal bridging across the building wall to limit thermal energy losses.

Cladding is typically applied to the exterior surfaces of buildings to provide a degree of thermal insulation and weather resistance, and often to improve the appearance of the building. Cladding can be made from a wide variety of materials in different forms including, for example, aluminum and other metals, wood, brick, vinyl, and composite materials that can include blends of cement and recycled polystyrene, etc.

Cladding can be applied over insulation with clips or other structures that are fastened to the building wall and extend through the insulation to support the cladding directly or via an arrangement of girts, rails, etc. The clips prevent wind load forces from detaching the cladding from the building during high winds.

DETAILED DESCRIPTION

Figure 1:
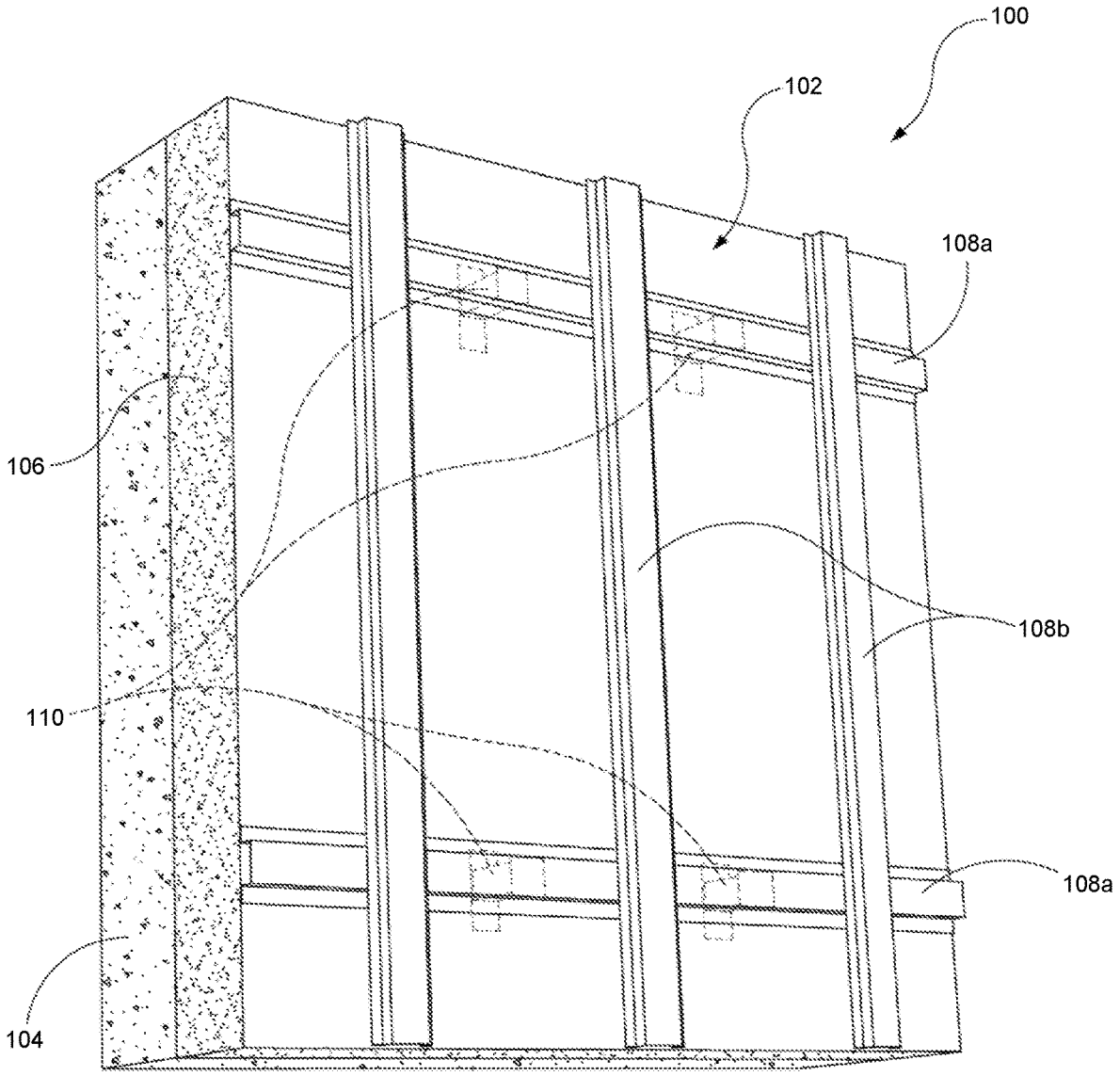
FIG. 1 is a left perspective view of a portion of an exterior wall assembly of a building having a cladding attachment system configured in accordance with some embodiments of the present technology.

The following disclosure describes various embodiments of devices, systems, and associated methods for attaching cladding components to a wall (e.g., a continuously or near-continuously insulated exterior wall) or other structure of a building. Unless the context clearly requires otherwise, the term "cladding component" is used herein for ease of reference to generally refer to any cladding support component and/or cladding material that may be attached to an exterior wall of a building. By way of non-limiting examples, such cladding components can include girts, rails, and/or other cladding support components, as well as cladding boards, panels, sheets, and other cladding materials. As described in greater detail below, various embodiments of the devices and systems described herein are modular devices and systems that can provide thermally insulated intermittent structural attachment solutions for attaching various types of cladding systems onto exterior wall assemblies having a relatively wide range of different insulation thicknesses.

For example, some cladding component attachment devices configured in accordance with embodiments of the present technology include a body comprised of a support member that is attached to a base which is in turn configured to be attached to a building wall structure. In some embodiments, the support member can be configured to operably carry both axial and bending loads imposed by the cladding component or components mounted to a distal end portion thereof. For example, in some embodiments such support members can be configured as a cantilevered beam comprised of a tube (e.g., a steel tube) having, e.g., a square, rectangular, circular, polygonal, and/or other cross-sectional shape. In other embodiments, such support members can be configured as beams having other configurations comprised of structures having non-tubular cross-sectional shapes. Cladding component attachment devices configured in accordance with further embodiments of the present technology can include support members configured to primarily carry axial loads imposed by the cladding component or components mounted to a distal end portion thereof. For example, in some embodiments such support members can be configured as a rod, (e.g., a fully or partially threaded elongate rod) or other thin straight bar configured to attach cladding components to the building wall structure. Such attachment devices can have a lower weight, cost, and thermal transmittance than attachment devices that are configured to carry both axial and bending loads, and as a result the use of such devices in areas where only axial load carrying capability is required can result in weight and cost savings and improved insulation. In various embodiments described herein, the bodies of the cladding component attachment devices can include features for adjusting the length of the device if needed to account for differences in insulation thickness and/or the wall or other substructure not being plumb.

Certain details are set forth in the following description and in FIGS. 1-7 to provide a thorough understanding of various embodiments of the present technology. In other instances, well-known structures, materials, operations and/or systems often associated with cladding, cladding support components and systems, insulation, building structures, etc. are not shown or described in detail in the following disclosure to avoid unnecessarily obscuring the description of the various embodiments of the technology. Those of ordinary skill in the art will recognize, however, that the present technology can be practiced without one or more of the details set forth herein, or with other structures, methods, components, and so forth.

The terminology used below is to be interpreted in its broadest reasonable manner, even though it is being used in conjunction with a detailed description of certain examples of embodiments of the present technology. Indeed, certain terms may even be emphasized below; however, any terminology intended to be interpreted in any restricted manner will be overtly and specifically defined as such in this Detailed Description section. Unless the context clearly requires otherwise, as used herein the terms "about," "generally," "substantially," and "approximately" refer to values within 10% of the stated value. In instances in which relative terminology is used in reference to something that does not include a numerical value, the terms are given their ordinary meaning to one skilled in the art.

The accompanying Figures depict embodiments of the present technology and are not intended to be limiting of its scope. The sizes of various depicted elements are not necessarily drawn to scale, and these various elements may be arbitrarily enlarged to improve legibility. Component details may be abstracted in the Figures to exclude details such as position of components and certain precise connections between such components when such details are unnecessary for a complete understanding of how to make and use the invention. Many of the details, dimensions, angles, and other features shown in the Figures are merely illustrative of particular embodiments of the present technology. Accordingly, other embodiments can have other details, dimensions, angles, and features without departing from the present disclosure. In addition, those of ordinary skill in the art will appreciate that further embodiments of the present technology can be practiced without several of the details described below. In the Figures, identical reference numbers identify identical, or at least generally similar, elements.

FIG. 1 is a left perspective view of a portion of an exterior wall assembly 100 having a cladding attachment system 102 configured in accordance with some embodiments of the present technology. The exterior wall assembly 100 can be an insulated exterior wall of a building, such as a commercial building, a residential building, etc., and can include insulation 106 that is positioned on an exterior side of an exterior wall 104. By way of example, the exterior wall 104 can form part of the building's primary structure, and can be comprised of concrete, wood, sheathing, studs (e.g., steel studs such as C-channel steel studs), or essentially any other type of exterior wall structure typically found on buildings, such as commercial buildings, residential buildings, etc. By way of example, the insulation 106 can include a mineral wool (e.g., ROCKWOOL®), foam boards or blocks (e.g., polystyrene, polyisocyanurate, polyurethane), loose-fill or blown-in insulation (e.g., cellulose, fiberglass, other mineral (rock or slag) wool), etc., as well as other types of known building insulation materials.

Embodiments of the cladding attachment system 102 can include a plurality of cladding component attachment devices, e.g., cladding component attachment devices 110 as described in greater detail below with reference to FIG. 2. Examples of embodiments of the cladding component attachment devices 110 are described in U.S. patent application Ser. No. 17/463,442, filed Aug. 31, 2021, and titled "CLADDING ATTACHMENT DEVICES, SYSTEMS, AND ASSOCIATED METHODS OF MANUFACTURE AND USE," which is incorporated by reference herein in its entirety. For ease of reference, the cladding component attachment device 110 and the other cladding component attachment devices described herein may be referred to at various times as a "component attachment device," an "attachment device," or even simply "a device."

The cladding component attachment devices 110 are configured to be attached to the exterior wall 104 and extend through the insulation 106 and structurally attach a plurality of cladding components 108*a* and 108*b* to the wall 104. In the illustrated embodiment, the cladding components 108*a* are generally arranged in a horizontal orientation and the cladding components 108*b* are generally arranged in a vertical orientation. In some embodiments, the cladding components 108*a* and 108*b* are elongate girts (e.g., galvanized steel girts having, e.g., "hat-shaped" cross-sections). In other embodiments, however, the cladding component attachment devices described herein can be used to attach a wide variety of different cladding support components to the building wall 104, including, for example, other types of girts, rails, and/or other types of structural members and/or secondary framing having various cross-sectional shapes (e.g., hat-shaped, Z-shaped, C-shaped, flat, etc.). In some embodiments, the cladding components 108*a* and 108*b* can have the same cross-sectional shape, and in other embodiments the cladding components 108*a* and 108*b* can have different cross-sectional shapes.

Figure 2:
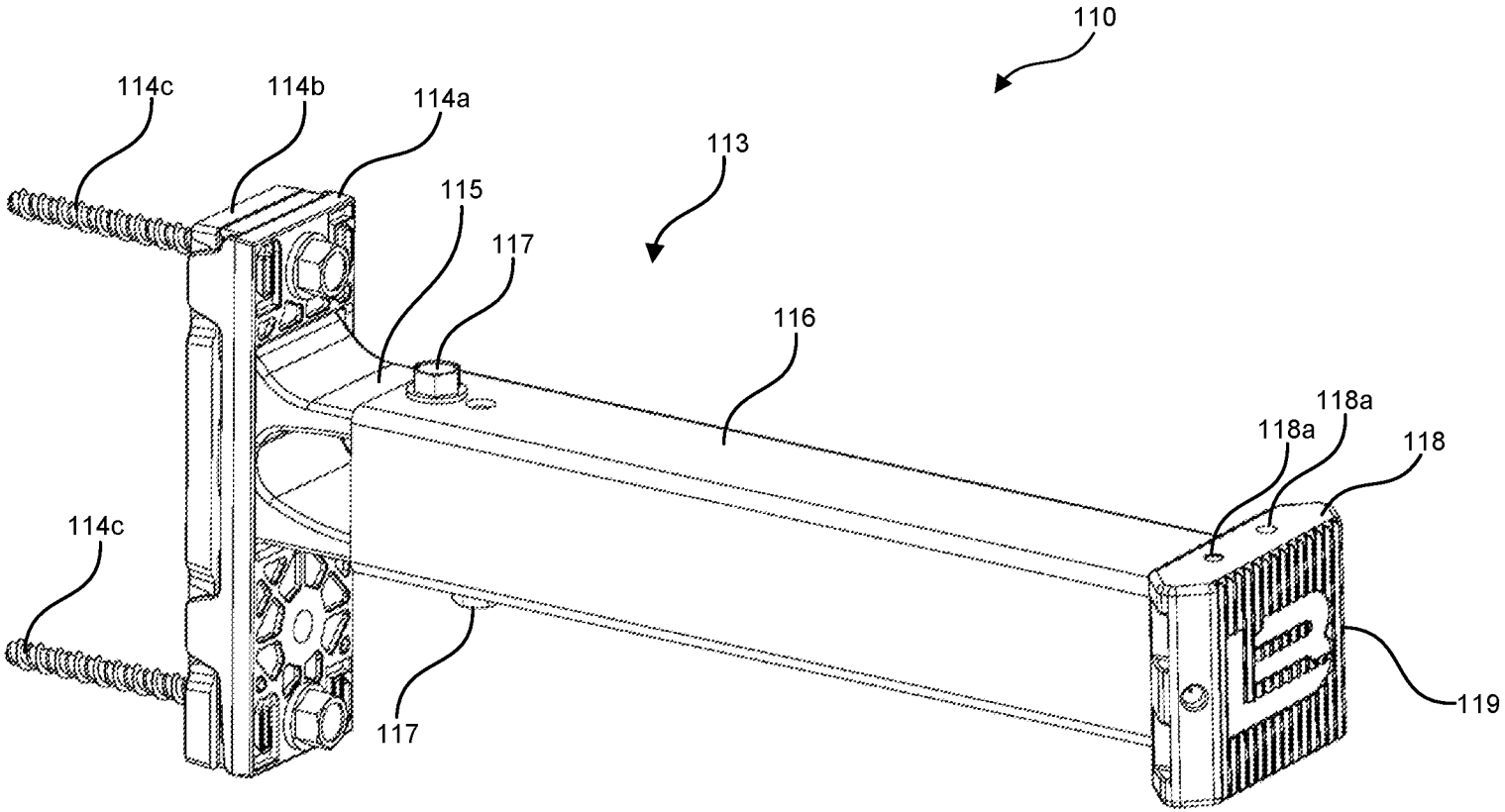
FIG. 2 is a perspective view of a cladding component attachment device configured in accordance with some embodiments of the present technology.

FIG. 2 is a perspective view of the cladding component attachment device 110 configured in accordance with some embodiments of the present technology. In the illustrated embodiment, the cladding component attachment device 110 includes a body 113 having a base member 115 with upper and lower flanges sandwiched between corresponding inner and outer plates 114*a* and 114*b*. Each of the upper and lower flanges of the base member 115 and the inner and outer base plates 114*a* and 114*b* include fastener apertures configured to receive corresponding fasteners 114*c* to operably attach the base member 115 to the exterior wall 104 (e.g., to a stud; not shown in FIG. 2). In this embodiment, the body 113 further includes a support member 116 (which can also be referred to as a support arm) operably coupled to the base member 115 by two or more fasteners 117 or other suitable attachment components. In some embodiments, the support member 116 can be at least partially encased or enclosed by an insulative sleeve (not shown) that provides a thermal break between the support member 116 and the surrounding insulation to enhance the thermal efficiency of the cladding component attachment device 110. In some embodiments, the sleeve can include cutouts to accommodate the fasteners 117. In some embodiments, the cladding component attachment device 110 can further include an end cap 118 positioned at a distal end 119 of the cladding component attachment device 110. The end cap 118 can have one or more fastener apertures 118*a* on opposite sides thereof configured to receive fasteners (e.g., screws; not shown) that extend though the apertures 118*a* and into corresponding fastener apertures in the distal end portion of the support member 116 to operably couple the cladding components 108*a* and/or 108*b* to the cladding component attachment device 110. In the illustrated embodiment, the end cap 118 can be optionally positioned in the orientation shown in FIG. 2 for attaching the cladding component 108*a* to the attachment device 110 in a horizontal orientation as shown in FIG. 1, or in a second orientation in which the end cap 118 is rotated 90 degrees relative to the orientation shown in FIG. 2 for attaching the cladding components 108*b* to the attachment device 110 in a vertical orientation.

In some embodiments, the support member 116 can be configured as a cantilevered beam to carry axial and bending loads from the cladding components attached thereto, and can be comprised of, e.g., a tube (e.g., a tube having a square cross-sectional shape as illustrated, or a tube having a rectangular cross-sectional shape, a circular cross-sectional shape, a polygonal cross-sectional shape, etc.). In other embodiments, the support member 116 can be configured as other types of beams having other cross-sectional shapes, such as an I-beam, a T-bar, an L-angle, a C-channel, etc. In some embodiments, the base member 115 and the support member 116 are configured to carry at least an applied load in a direction parallel to the exterior wall (e.g., corresponding to the static mass, thermal expansion, dynamic vibration, and/or other loading based on the weight or movement of the cladding material operably coupled to the cladding components 108*a* and 108*b*). Various mounting configurations of the cladding attachment system 102 can require different lengths of the cladding component attachment device 110, e.g., to correspond to the thickness of the insulation 106 and/or to accommodate variation in the flatness of the exterior wall 104, etc.

Figure 3A:
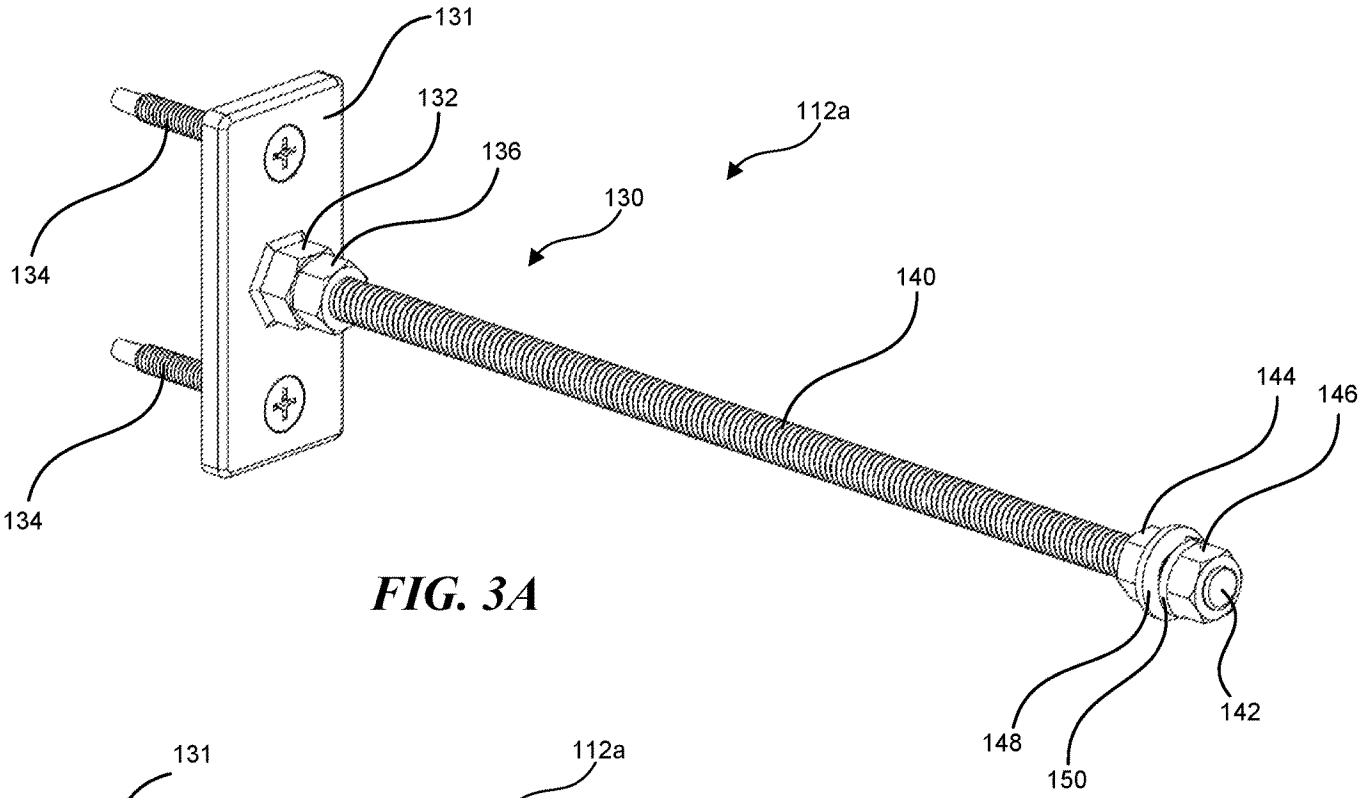
FIGS. 3A and 3B are perspective and side elevation views, respectively, of a cladding anchor configured in accordance with some embodiments of the present technology.
Figure 3B:
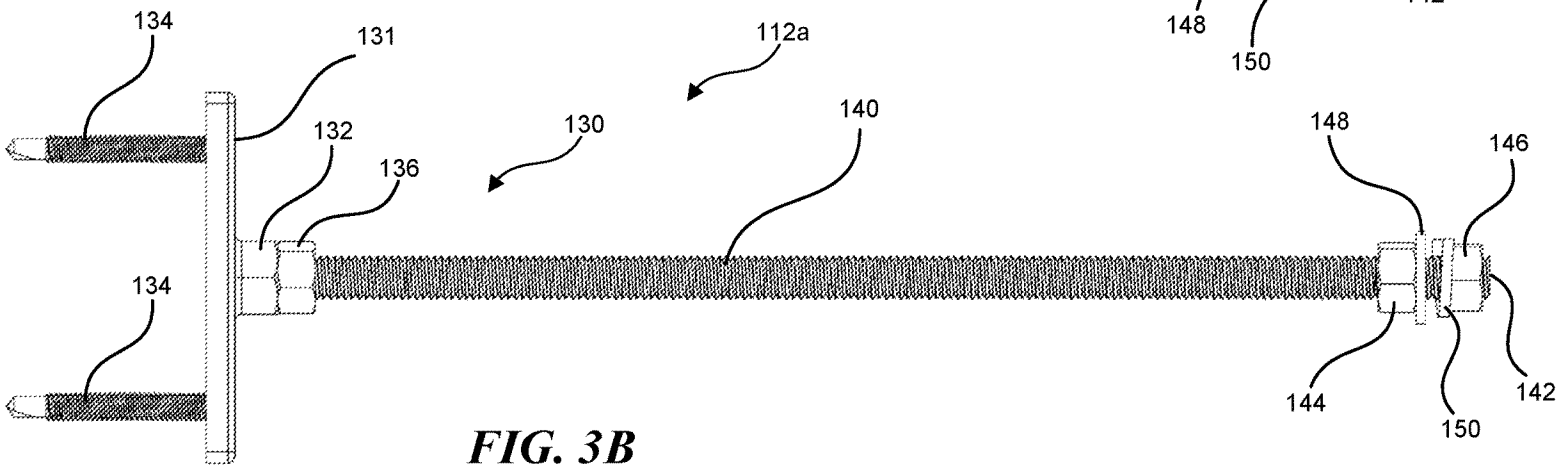

FIGS. 3A and 3B are perspective and side elevation views, respectively, of a cladding component attachment device 112*a* configured in accordance with some embodiments of the present technology. For ease of reference the cladding component attachment device 112*a* may be referred to herein as the "cladding anchor 112*a*" and/or at various times as a "wind load anchor" and/or a "sliding point anchor." In the illustrated embodiment, the cladding anchor 112*a* has a body 130 that includes a base 131 (e.g., a steel mounting bracket, hanger flange, nutplate, etc.) and a support member 140. Two or more fasteners 134 can operably couple the base 131 to the exterior wall 104 (e.g., to a stud; not shown in FIGS. 3A or 3B), and the base 131 can further include an integral nut 132 welded or otherwise fixedly attached thereto.

In the illustrated embodiment, the support member 140 is configured as a rod having a round cross-sectional shape, and for ease of reference may be referred to herein as the "rod 140." The base 131 (e.g., by the integral nut 132) can be configured to operably receive a threaded proximal end portion of the rod 140 to thereby secure the rod 140 to the base 131. A secondary jam nut 136 can secure the rotational position of the rod 140 with respect to the integral nut 132. Although the rod 140 is shown as a fully threaded rod, in other embodiments, the rod 140 can be only partially threaded at one or both ends of the rod and/or the rod 140 can be otherwise operably coupled to the base 131 (e.g., welded, bonded, fastened with screws, bolts, etc.). Various mounting configurations of the cladding attachment system 102 can require different lengths of the rod 140, e.g., to correspond to the length of the cladding component attachment devices 110, the thickness of the insulation 106 (not shown in FIGS. 3A or 3B), and/or to accommodate variation in the flatness or plumbness of the exterior wall 104, etc. The rod 140 can be specified in different lengths or cut to size in the field to accommodate the various mounting configurations, and/or minor adjustments to the length of the rod 140 can be made in the field by screwing the rod 140 into or out of the nut 132 and locking it into place with the jam nut 136. In other embodiments, the rod 140 can be other rods and/or other relatively thin, straight bars have any suitable solid or hollow cross-sectional shape, e.g., round, square, rectangular, hexagonal, octagonal, etc. The cladding anchor 112*a* can be configured to carry an applied load in a direction perpendicular to an exterior wall of a building (e.g., corresponding to a wind load). The cladding anchor 112*a* can have a comparatively lighter weight, lower thermal transmittance, and lower cost than the cladding component attachment device 110 described above. As will be explained in greater detail below, in some embodiments the cladding anchor 112*a* can be installed in place of some of the cladding component attachment devices 110 to carry axial loads (e.g., wind loads) where the bending load carrying capacity of the attachment devices 110 is not required.

Figure 4A:
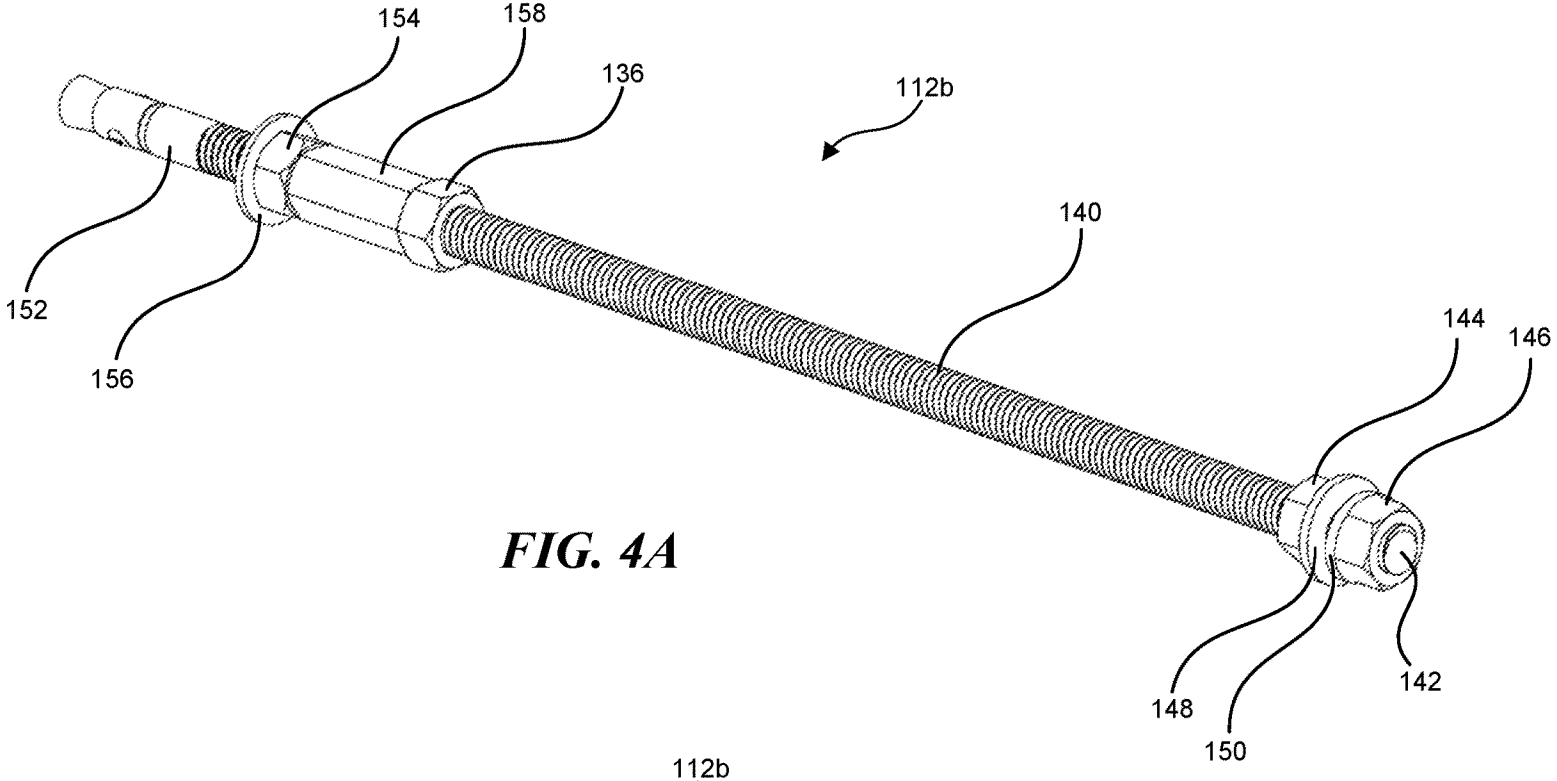
FIGS. 4A and 4B are perspective and side elevation views, respectively, of another cladding anchor configured in accordance with some embodiments of the present technology.
Figure 4B:
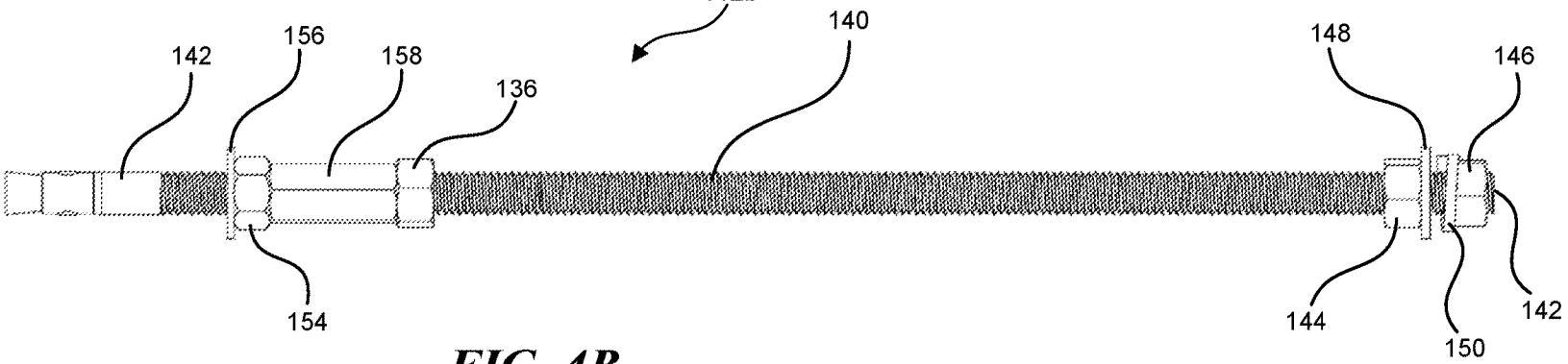

The cladding anchor 112*a* can further include first and second mounting nuts 144 and 146, respectively, at a distal end portion 142 of the rod 140 to adjustably attach, e.g., the cladding components 108*a* and/or 108*b* to the distal end portion 142 of the cladding anchor 112*a*. First and second washers 148 and 150 can be arranged between and adjacent to the first and second mounting nuts 144 and 146, respectively. As shown, the second washer 150 can be a locking-type split washer to resist loosening of the second nut 146 after installation of the cladding component 108*a* and/or 108*b*. In other embodiments, any suitable locking fastener configuration can be used (e.g., locking adhesive liquid, a locking nut, different types of locking washers, etc.). As described above, the distal end portion 142 of the rod 140 can have a threaded depth such that the first and second nuts 144 and 146 can be adjusted along the length of the rod 140 to accommodate variations in the distance between the exterior wall 104 and cladding 120 (see FIGS. 5 and 6). The cladding anchor 112*a* is shown with a mounting bracket/nutplate-type base 131, which can be suitable for operably coupling the cladding anchor 112*a* to some building materials, e.g., to steel studs, wood studs, and/or other building materials. As shown in FIGS. 4A and 4B, however, in other embodiments cladding anchors configured in accordance with the present technology can be configured to be operably coupled to concrete by using an expanding-type anchor base (e.g., a concrete wedge anchor or the like), a chemically bonded anchor base (e.g., an epoxy anchor or the like), a friction anchor base, etc. instead of the hanger flange/nutplate-type base 131, and in further embodiments cladding anchors can have any other suitable base for operably coupling the cladding anchors to an exterior wall or other structure of a building.

FIGS. 4A and 4B are perspective and side elevation views, respectively, of a cladding component attachment device 112*b* configured in accordance with some embodiments of the present technology. For ease of reference the cladding component attachment device 112*b* may be referred to herein as the "cladding anchor 112*b*" and/or at various times as a "wind load anchor" and/or a "sliding point anchor." The cladding anchor 112*b* is structurally and functionally similar to the cladding anchor 112*a* described above; however, instead of including a base similar to the base 131 of the cladding anchor 112*a*, the cladding anchor 112*b* includes a anchoring portion 152 (e.g., a friction-fit expanding concrete anchor, a chemically bonded anchor, etc.) which can have a locking nut 154 and a washer 156. The anchoring portion 152 can operably couple the cladding anchor 112*b* to the exterior wall 104 (e.g., to concrete). The cladding anchor 112*b* can include a coupling nut 158 configured to engage a threaded portion of the anchoring portion 152 and can be configured to operably receive the rod 140 therein to secure the rod 140 to the anchoring portion 152. The secondary jam nut 136 can secure the rotational position of the rod 140 with respect to the coupling nut 158. Although the rod 140 is shown as a fully threaded rod, in other embodiments, the rod 140 can be only partially threaded at one or both ends of the rod and/or the rod 140 can be otherwise operably coupled to the anchoring portion 152 (e.g., welded, bonded, etc.). Various mounting configurations of the cladding attachment system 102 can require different lengths of the rod 140, e.g., to correspond to the length of the cladding component attachment devices 110, to accommodate variation in the flatness of the exterior wall 104, etc. To satisfy this requirement, the rod 140 can be specified in different lengths or cut to size in the field to accommodate the various mounting configurations, and/or minor adjustments to the length of the rod 140 can be made in the field by screwing the rod 140 into or out of the nut 158 and locking it into place with the jam nut 136.

The cladding anchor 112*b* can further include the first and second mounting nuts 144 and 146, respectively, at the distal end portion 142 of the rod 140 to adjustably attach, e.g., the cladding components 108*a* and/or 108*b* to the distal end portion 142 of the cladding anchor 112*b* as described above for the cladding anchor 112*a*. First and second washers 148 and 150 can be arranged adjacent to the first and second mounting nuts 144 and 146, respectively. As shown, the second washer 150 can be a locking-type split washer to resist loosening of the second nut 146 after installation. In other embodiments, any suitable locking fastener configuration can be used (e.g., locking adhesive fluid, a locking nut, a different type of locking washer, etc.). As described above, the distal end portion 142 of the rod 140 can have a threaded depth such that the first and second nuts 144 and 146 can be adjusted along the length of the rod 140 to accommodate variations in the distance between the exterior wall 104 and the cladding 120. The cladding anchor 112*b* can be configured to carry an applied load in a direction perpendicular to the exterior wall (e.g., corresponding to a wind load). The cladding anchor 112*b* can have a comparatively lighter weight, lower thermal transmittance, and reduced cost than the cladding component attachment device 110. As will be explained in greater detail below, in some configurations the cladding anchor 112*b* can be installed in place of some of the cladding component attachment devices 110 to carry axial loads (e.g., wind loads) in those locations where the bending load carrying capacity of the attachment devices 110 is not required. The components of the cladding anchors 112*a* and 112*b* (e.g., the base 131, the support 140, etc.) can be formed from any suitable material, such as steel, stainless steel, aluminum, brass, bronze, zinc plated steel, nickel, titanium, etc., and can have any combination of treatment, hardening, and/or coating. In some embodiments, the components of the cladding anchors 112*a* and 112*b* can be formed from stainless steel to reduce thermal transmittance through the cladding anchors 112*a* and 112*b*.

Figure 5:
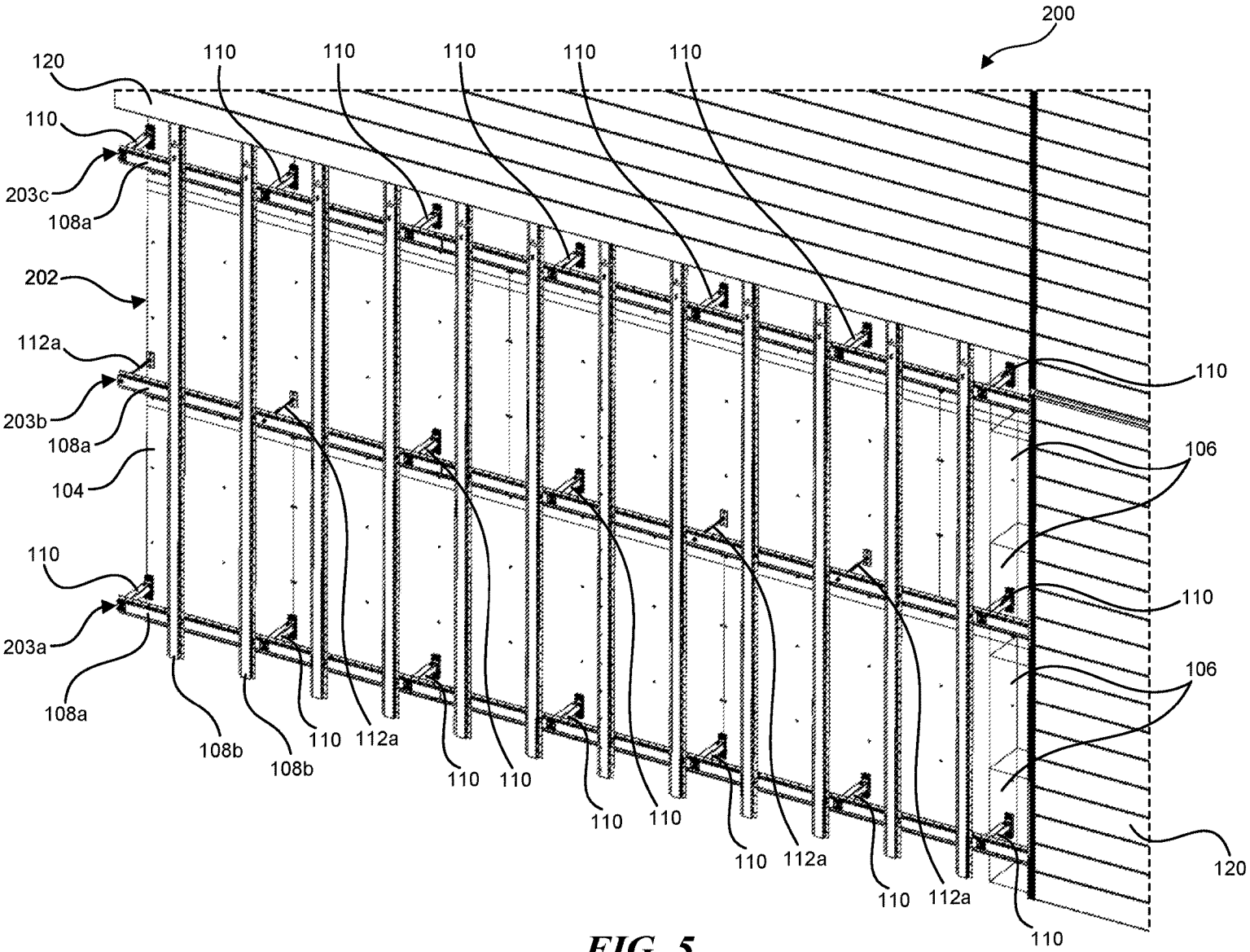
FIG. 5 is a right perspective view of a portion of another exterior wall assembly having a cladding attachment system configured in accordance with some embodiments of the present technology.
Figure 6:
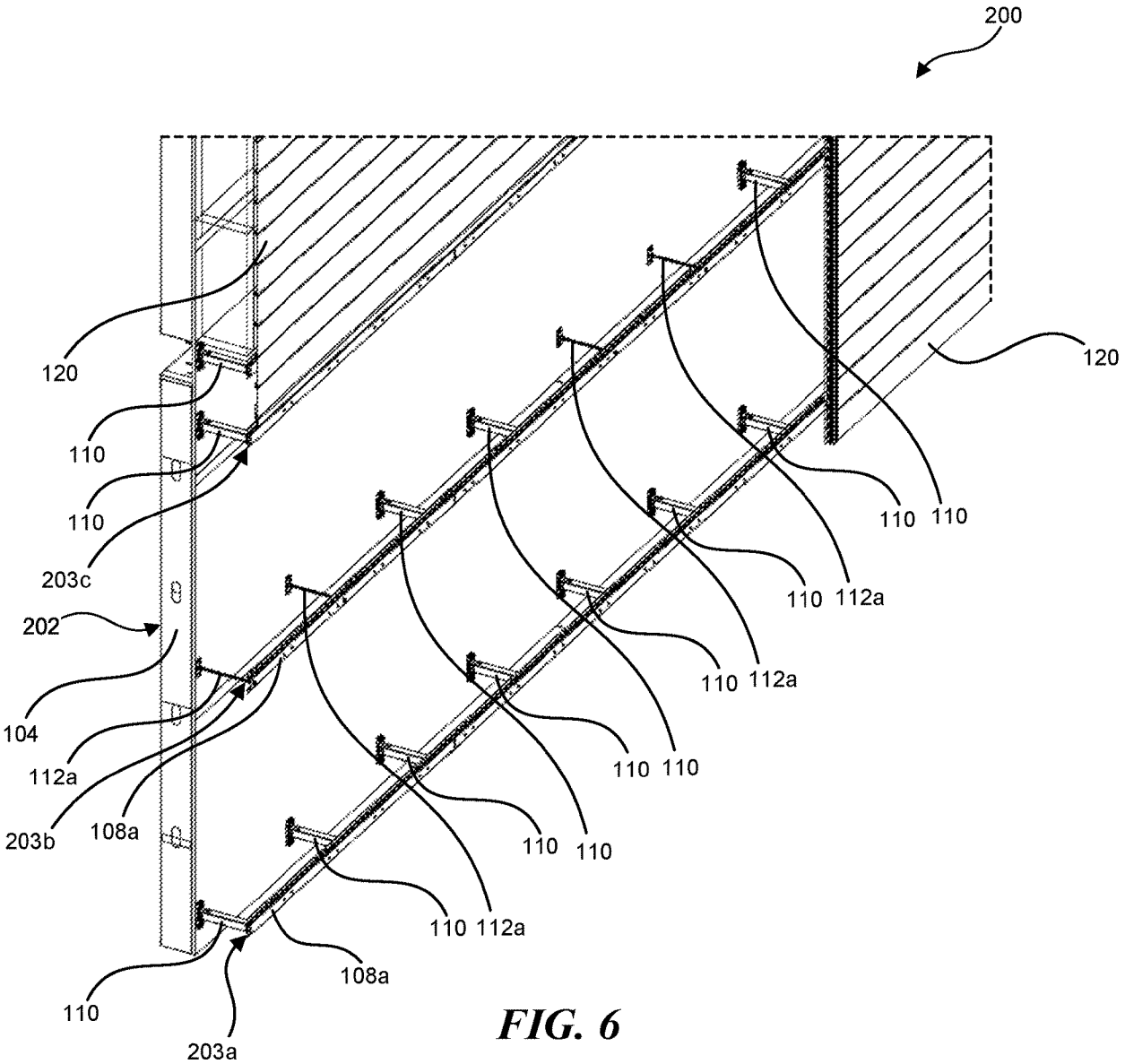
FIG. 6 is a left perspective view of a portion of the exterior wall assembly of FIG. 5 configured in accordance with some embodiments of the present technology.
Figure 7:
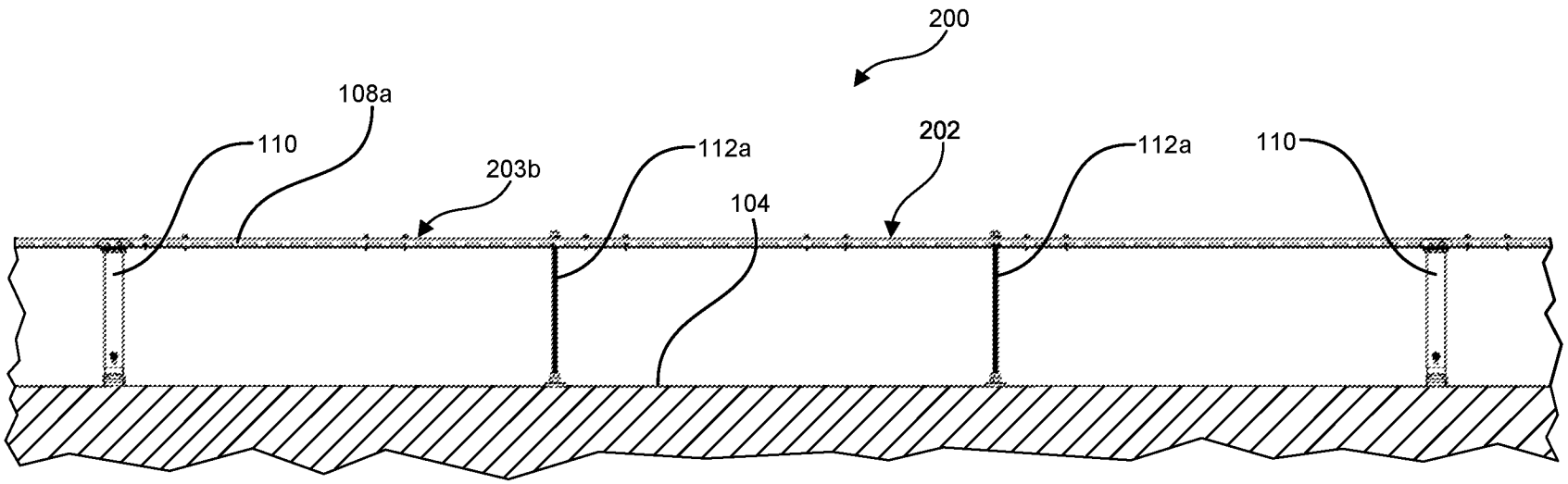
FIG. 7 is a top plan view of a portion of the exterior wall assembly of FIG. 6.

FIGS. 5 and 6 are right and left perspective views, respectively, of portions of an exterior wall assembly 200 having a cladding attachment system 202 configured in accordance with some embodiments of the present technology, and FIG. 7 is a top cross-sectional plan view of a portion of the exterior wall assembly 200 configured in accordance with some embodiments of the present technology. In some embodiments, the exterior wall assembly 200 can be at least generally similar in structure and function to the exterior wall assembly 100 described above with reference to FIG. 1. For example, in some embodiments the exterior wall assembly 200 can include the building wall 104 and the exterior insulation 106. In addition, in FIGS. 5 and 6 cladding 120 has been attached to the cladding components 108*a* and 108*b*, but a portion of the cladding 120 has been omitted and some of the underlying insulation 106 has been omitted or shown as a transparent component for purposes of better illustrating the configuration of certain cladding attachment system components. Similarly, in FIG. 7 the insulation 106 and the cladding 120 has been omitted to more clearly illustrate the configuration of certain cladding attachment system components.

Referring initially to FIG. 5, the cladding attachment system 202 can include a first row 203*a* having a plurality of the cladding component attachment devices 110 operably coupling the cladding components 108*a* to the building wall 104 in a horizontal orientation. The plurality of cladding component attachment devices 110 can be arranged along the wall 104 at a suitable horizontal spacing for supporting the cladding 120 under various loading conditions including, e.g., loads associated with the weight of the cladding and the cladding components, wind loads, vibrational loads, thermal expansion/contraction loads, seismic loads, etc. By way of example and as shown in FIGS. 5 and 6, the plurality of cladding component attachment devices 110 can be substantially evenly horizontally spaced apart in the first row 203*a* along the wall 104/the cladding component 108*a*, and in some embodiments can be positioned to generally align with studs (not shown) in the exterior wall 104 (e.g., 16-inch spaced vertical studs, 24-inch spaced vertical studs, etc.). In some embodiments, the cladding components 108*b* are arranged in a vertical orientation laterally offset from the plurality of cladding component attachment devices 110 in the first row 203*a* so that the cladding components 108*b* are not in vertical alignment with the cladding component attachment devices 110 and the fasteners operably coupling the cladding component 108*a* the corresponding cladding component attachment devices 110 do not interfere with the cladding components 108*b*. As will be appreciated by those of ordinary skill in the art, the illustrated arrangement of the cladding components 108*a* and 108*b* is but one example of a suitable arrangement configured in accordance with the present technology, and in other embodiments the cladding components 108*a* and 108*b* can have other arrangements consistent with the present disclosure. For example, in the illustrated embodiment of FIG. 5, the cladding attachment system 202 is generally arranged with twice as many cladding components 108*b* as cladding component attachment devices 110 along the first row 203*a*. In other embodiments, any suitable number of cladding components 108*b* compared to the number of cladding component attachment devices 110 is within the scope of the present disclosure.

The cladding attachment system 202 can further include a second row 203*b* having a plurality of the cladding component attachment devices 110 operably coupling the cladding components 108*a* to the building wall 104 in a horizontal orientation and vertically spaced apart from the cladding components 108*a* and the plurality of cladding component attachment devices 110 in the first row 203*a*. The plurality of cladding component attachment devices 110 in the second row 203*b* can be arranged along the wall 104, e.g., at various lateral positions vertically aligned with some of the plurality of cladding component attachment devices 110 in the first row 203*a*. In one aspect of this embodiment, the second row 203*b* can further include a plurally of the cladding anchors 112*a* (or the cladding anchors 112*b* for concrete walls, not shown in FIGS. 5-7) in certain of the lateral positions vertically aligned with some of the plurality of cladding component attachment devices 110 in the first row 203*a*. For example, in some embodiments, pairs of the cladding anchors 112*a* in the second row 203*b* can be interspersed equidistant between adjacent pairs of the cladding component attachment devices 110 in the second row 203*b*. In this regard, when comparing the plurality of cladding component attachment devices 110 in the first and second rows 203*a* and 203*b*, the second row 203*b* has fewer of the cladding component attachment devices 110 operably coupling the cladding component 108*a* to the exterior wall 104 than the first row 203*a*, and instead additionally includes some of the cladding anchors 112*a* operably coupling the cladding components 108*a* to the building wall 104. Replacing the attachment devices 110 with the cladding anchors

112*a* in those locations in the second row 203*b* where the full load carrying capacity of the devices 110 is not required can reduce the weight, cost, and thermal transmittance losses that would otherwise be associated with the cladding attachment system 202. Although the plurality of cladding component devices 110 are shown arranged in the first row 203*a* without any (e.g., interspersed) cladding anchors 112*a*, in other embodiments the cladding anchors 112*a* can be installed in any suitable positions and with any suitable sequence and/or quantity in the first row 203*a* to meet the applicable cladding load requirements. Similarly, any row or column in the cladding attachment system 202 can be arranged without interspersed cladding anchors 112*a* or 112*b*, e.g., if the loading requirements at a certain position require a higher bending load rating, the row is near a floor, a corner, a seam between two cladding attachment systems, and/or if needed or desirable to satisfy some other design requirement, etc.

In some embodiments, the cladding attachment system 202 can further include a third row 203*c* having a plurality of the cladding component attachment devices 110 operably coupling the cladding components 108*a* to the building wall 104 in a horizontal orientation be vertically aligned with the cladding component attachment devices 110 in the first row 203*a*, e.g., without interspersed cladding anchors 112*a* positioned in either the first row 203*a* or the third row 203*c*. However, in other embodiments the plurality of cladding component attachment devices 110 in the third row 203*c* can be arranged in any suitable sequence with any suitable number of cladding anchors 112*a* interspersed between the cladding component attachment devices 110 to suit the particular loading requirements. Further rows of the cladding components 108*a*, the cladding component attachment devices 110, and/or the cladding anchors 112*a* can be operably coupled to the exterior wall 104 in virtually any suitable arrangement as needed to cover a desired portion of the exterior wall 104 with the cladding 120 and/or other cladding components and carry the applied loads (e.g., wind loads, deadloads, etc.).

The vertical and horizontal spacing of the cladding components 108*a* and 108*b* and the lateral spacing and sequence of the cladding component attachment devices 110 and cladding anchors 112*a* in each of the rows 203*a*, 203*b*, and 203*c* can be determined based on various factors, including the loading forces related to the cladding, e.g., component mass, wind loading, vibration loading, thermal expansion/contraction loading, seismic loading, etc. Wind loading on the cladding 120 is generally the highest loading force experienced by the cladding attachment system 202, and the wind loading can be especially high at the corners of the exterior wall assembly 100 and at the roof transition areas of a building structure. The wind loading on the cladding 120 is greatest, or is typically greatest, in suction, which tends to exert a pulling force on the cladding 120 in a direction away from the exterior wall 104 (e.g., outwardly from the wall 104 and perpendicular, or approximately perpendicular, to the wall 104). The cladding anchors 112*a* and 112*b* have the greatest loading capacity in tension to correspond to the wind suction load direction, which allows the cladding anchors 112*a* and 112*b* to carry the suction wind forces in conjunction with the cladding component attachment devices 110. Although the cladding anchors 112*a* and 112*b* can carry some of the wind compression load forces, the cladding component attachment devices 110 are intended to carry most of the compression loading.

In some embodiments, the cladding anchors 112*a* and 112*b* (referred to hereafter as "cladding anchors 112") can be arranged in place of some of the cladding component attachment devices 110, and together with the cladding component attachment devices 110 can absorb the wind loading of the cladding 120, while the cladding component attachment devices 110 additionally provide bending load support related to the mass loading, vibration loading, thermal expansion/contraction loading, seismic loading, etc. of the cladding components 108*a* and 108*b*, the cladding 120, and any other cladding components attached to the exterior wall assembly 100 by the cladding attachment system 202. Such mass loading, vibration loading, etc. may be applied in directions parallel, or approximately parallel, to the outer surface of the exterior wall 104. In this regard, by including cladding anchors 112 interspersed at certain positions along the rows of cladding components 108*a*, the cladding attachment system 202 can carry the relatively high wind loads with fewer of the cladding component attachment devices 110 than a cladding attachment system that uses only one type of attachment device (e.g., a heavy-duty device that carries bending loads). For example, in some embodiments, the cladding component attachment devices 110 are configured to carry a design load in a direction parallel to the exterior wall 104 (e.g., downward) that is ten times greater than the design load parallel to the exterior wall 104 that the cladding anchors 112 are configured to carry. The position, sequence, etc. of the cladding anchors 112 can be dictated or otherwise arranged based on the loading requirements. In these embodiments, fewer cladding component attachment devices 110 can satisfy the loading requirements (mass, vibration, thermal, seismic, etc.) of the components of the exterior wall assembly 100 (e.g., the cladding 120 and the cladding components 108*a* and 108*b*, etc.) and the cladding anchors 112 can be installed at certain positions to satisfy the relatively high wind loading requirements.

The cladding component attachment devices 110 and cladding anchors 112 can extend from the exterior wall 104 through the insulation 106 and operably couple to the cladding 120 through the cladding components 108*a* and 108*b*. In these configurations, the cladding component attachment devices 110 and cladding anchors 112 form thermal conductive pathways (e.g., thermal bridges) between the exterior wall 104 and the cladding 120, and can therefore reduce the heating and cooling efficiency of the building by way of thermal transmittance (e.g., transmitting heat inward during cooling of the interior of the building and/or conducting heat outward during heating of the building). As described above, in some embodiments the cross-sectional area of the cladding component attachment devices 110 is greater than the cross-sectional area of the cladding anchors 112 which, for similar materials having the same or similar thermal transmittance, corresponds to the component attachment devices 110 having a greater thermal bridging effect. By way of example only, in some embodiments the thermal energy transfer rate through the cladding anchors 112 is between 10% and 50%, between 15% and 35%, or 25% of the thermal energy transfer rate through the cladding component attachment devices 110. Accordingly, the thermal performance of the cladding attachment system 202 increases by installing some of the cladding anchors 112 in place of the cladding component attachment devices 110 while still satisfying the loading requirements of the cladding attachment system 202. In one aspect of some embodiments of the present technology, the cladding component attachment devices 110 can be positioned at relatively large spacing because of their relatively high structural load capacity (e.g., for mass loading, vibration loading, thermal loading, seismic loading, etc.), and the cladding anchors 112 can be positioned as necessary to satisfy the wind loading requirements, thereby reducing the overall number of cladding component attachment devices 110 required for a particular application, reducing the thermal bridging effect of the cladding attachment system 202.

In the illustrated embodiments, the cladding anchors 112 operably couple the cladding component 108*a* to the building wall 104 in positions along the rows 203*a*, 203*b*, and 203*c* by installing the cladding anchors 112 in certain positions instead of the cladding component attachment devices 110. By way of example only, in some embodiments the cladding component 108*a* can be operably coupled to the building wall 104 by alternating pairs of laterally adjacent cladding anchors 112 and laterally adjacent cladding component attachment devices 110 (e.g., the sequence shown in the second row 203*b*). In this regard, the sequence of attachment devices along the length of the cladding component 108*a* can include two adjacent cladding anchors 112, two adjacent cladding component attachment devices 110, two adjacent cladding anchors 112, two adjacent cladding component attachment devices 110, and so on. In other embodiments, the cladding anchors 112 and the cladding attachment devices 110 can be arranged in virtually any combination, sequence, pattern, and/or arrangement, etc. as necessary to carry the applicable design load requirements dictated by the various loading forces related to the cladding 120.

As will be appreciated by those of ordinary skill in the art, the cladding anchors 112 can alternate or otherwise be placed in any suitable sequence, pattern, arrangement, etc. with the cladding attachment devices 110 along the rows of the cladding components 108*a*, e.g., one anchor 112 between each pair of attachment devices 110, two anchors 112 between each pair of attachment devices 110, three anchors 112 between each pair of attachment devices 110, etc., and/or can change these sequences or patterns at any position along the length of the cladding component 108*a*. Similarly, each row can have the same or a different sequence than the other rows, e.g., adjacent rows of cladding components 108*a* (e.g., the first row 203*a* and the second row 203*b*) can have the cladding anchors 112 positioned at different lateral positions such that the vertical spacing of the cladding component attachment devices 110 is suitable for the loading requirements. By way of example only, if the studs of the exterior wall 104 are arranged at 16-inch spacing, two cladding component attachment devices 110 can be positioned 32-inches apart with one cladding anchor 112 therebetween, or two cladding component attachment devices 110 can be positioned 48-inches apart with two cladding anchors 112 therebetween, etc. Likewise, if the studs are arranged at 24-inch spacing, two cladding component attachment devices 110 can be positioned 48-inches apart with one cladding anchor 112 therebetween, or at any other suitable spacing arrangement to carry the loading requirements. In some embodiments, the spacing between two cladding component attachment devices 110 in the vertical direction (e.g., along a stud of the exterior wall 104) can be from 96-inches, or about 96 inches, to 120-inches, or about 120 inches, or greater, with one, two, etc. cladding anchors 112 therebetween. It will be appreciated that any other horizontal or vertical spacing of the cladding component attachment devices 110 and the cladding anchors 112 is also within the scope of the present technology.

Although portions of the present disclosure describe the cladding component attachment devices 110 and the cladding anchors 112 for use in attaching girts (e.g., the cladding components 108*a* and 108*b*) to an exterior portion of building walls, it will be understood that the cladding component attachment devices 110, the cladding anchors 112, and various embodiments thereof can be used to attach a wide variety of cladding and/or cladding support components, and/or other materials, to building walls and/or other portions of buildings or other structures, in accordance with the present technology. Although referred to herein as "cladding component attachment devices 110" or "cladding anchors 112" in some embodiments, the cladding component attachment devices 110 and/or the cladding anchors 112 can also be referred to as "clips," "brackets," "wind load anchors," "sliding point anchors," and the like. Similarly, in some embodiments, the cladding attachment system 202 can be referred to as a "clip/anchor and rail" attachment system, a "panel" attachment system, an "exterior finish" attachment system, and the like.

Those of ordinary skill in the art will understand that the cladding components 108*a* and 108*b* can support a wide variety of different types of cladding 120 including, for example, LONGBOARD® cladding (which is extruded, architectural-grade aluminum cladding provided by Longboard Architectural Products of 1777 Clearbrook Road, Abbotsford, BC, V2T 5X5, Canada), other types of metal (e.g., aluminum) cladding and panels, fiber cement panels, phenolic panels, aluminum composite material (ACM) panels, etc. Accordingly, the cladding component attachment devices and cladding attachment systems described herein are not limited to use with any particular type of cladding support component or arrangement, any particular type of cladding or other exterior finish material, and/or other material or component, unless the context clearly requires otherwise.

References throughout the foregoing description to features, advantages, benefits, or similar language do not imply that all of the features and advantages that may be realized with the present technology should be or are in any single embodiment of the present technology. Rather, language referring to the features and advantages is understood to mean that a specific feature, advantage, or characteristic described in connection with an embodiment is included in at least one embodiment of the present technology. Thus, discussion of the features and advantages, and similar language, throughout this specification may, but do not necessarily, refer to the same embodiment. Furthermore, the described features, advantages, and characteristics of the present technology may be combined in any suitable manner in one or more embodiments. One skilled in the relevant art will recognize that the present technology can be practiced without one or more of the specific features or advantages of a particular embodiment. In other instances, additional features and advantages may be recognized in certain embodiments that may not be present in all embodiments of the present technology.

Any patents and applications and other references noted above, including any that may be listed in accompanying filing papers, are incorporated herein by reference in the entirety, except for any subject matter disclaimers or disavowals, and except to the extent that the incorporated material is inconsistent with the express disclosure herein, in which case the language in this disclosure controls. Aspects of the present technology can be modified, if necessary, to employ the systems, functions, and concepts of the various references described above to provide yet further implementations of the present technology.

The above Detailed Description of examples and embodiments of the present technology is not intended to be exhaustive or to limit the present technology to the precise form disclosed above. While specific examples for the present technology are described above for illustrative purposes, various equivalent modifications are possible within the scope of the present technology, as those skilled in the relevant art will recognize. The teachings of the present technology provided herein can be applied to other systems, not necessarily the system described above. The elements and acts of the various examples described above can be combined to provide further implementations of the present technology. Some alternative implementations of the present technology may include not only additional elements to those implementations noted above, but also may include fewer elements. Further any specific numbers noted herein are only examples: alternative implementations may employ differing values or ranges.

From the foregoing, it will be appreciated that specific embodiments of the present technology have been described herein for purposes of illustration, but that various modifications may be made without deviating from the spirit and scope of the various embodiments of the present technology. Further, while various advantages associated with certain embodiments of the present technology have been described above in the context of those embodiments, other embodiments may also exhibit such advantages, and not all embodiments need necessarily exhibit such advantages to fall within the scope of the present technology. Accordingly, the present technology is not limited, except as by the appended claims.

Although certain aspects of the present technology are presented below in certain claim forms, the applicant contemplates the various aspects of the present technology in any number of claim forms. Accordingly, the applicant reserves the right to pursue additional claims after filing this application to pursue such additional claim forms, in either this application or in a continuing application.

We claim:

1. A system for attaching a cladding component to an exterior wall of a building, the system comprising:

a first cladding component attachment device having a proximal end portion attached to the exterior wall and a distal end portion spaced apart from the exterior wall and attached to the cladding component;

a second cladding component attachment device having a proximal end portion attached to the exterior wall and a distal end portion spaced apart from the exterior wall and attached to the cladding component, wherein each of the first and second cladding component attachment devices includes a beam extending between the proximal end portion and the distal end portion, each of the beams having a first cross-sectional shape; and at least one cladding anchor having a base attached to the exterior wall between the first and second cladding component attachment devices, wherein the base is a plate having one or more apertures configured to receive a fastener for attaching the cladding anchor to the exterior wall of the building; and a rod having a proximal end portion attached to the base and a distal end portion spaced apart from the exterior wall and attached to the cladding component, wherein the rod has a second cross-sectional shape different than the first cross-sectional shape.

2. The system of claim 1, wherein the attachment of the distal end portion of the rod to the cladding component is adjustable along the rod in an axial direction.

3. The system of claim 1, wherein the at least one cladding anchor is positioned directly adjacent to the first cladding component attachment device and the second cladding component attachment device.

4. The system of claim 1, wherein the cladding component is an elongate girt arranged in a horizontal orientation with respect to the exterior wall.

5. The system of claim 4, wherein the elongate girt is configured to operably couple a cladding material to the exterior wall.

6. The system of claim 4, wherein the elongate girt is a first elongate girt, and wherein:

the system further comprises a second elongate girt attached to the first elongate girt, the second elongate girt is arranged in a vertical orientation with respect to the exterior wall, and the second elongate girt is configured to operably couple a cladding material to the first elongate girt.

7. The system of claim 1, wherein an insulation material is positioned between the exterior wall and the cladding component, and wherein the first and second cladding component attachment devices and the at least one cladding anchor extend through the insulation material.

8. The system of claim 7, wherein the first and second cladding component attachment devices have a higher thermal transmittance between the exterior wall and the cladding component than the at least one cladding anchor.

9. The system of claim 1, further comprising a nut integral with the plate and/or fixedly attached thereto, wherein the nut is configured to receive a threaded portion of the proximal end portion of the rod.

10. The system of claim 1, wherein the base of the cladding anchor is an anchoring portion for attaching the cladding anchor to the exterior wall of the building.

11. The system of claim 1, wherein the rod is solid.

12. The system of claim 1, wherein the rod is hollow.

13. The system of claim 1, wherein the second cross-sectional shape is round.

14. The system of claim 1, wherein the second cross-sectional shape is square, rectangular, hexagonal, or octagonal.

15. The system of claim 1, wherein the first cross-sectional shape is a rectangular shape.

16. The system of claim 1, wherein the first cross-sectional shape is a circular shape.

17. The system of claim 1, wherein the first cross-sectional shape is a polygonal shape, an I-beam shape, a T-bar shape, an L-angle shape, or a C-channel shape.

18. The system of claim 1 wherein two of the at least one cladding anchors are positioned adjacent to each other between the first and second cladding component attachment devices, and wherein the first and second cladding component attachment devices and the two cladding anchors are arranged in a row.

19. A system for attaching a cladding component to an exterior wall of a building, the system comprising:

a first cladding component attachment device having a proximal end portion attached to the exterior wall and a distal end portion spaced apart from the exterior wall and attached to the cladding component;

a second cladding component attachment device having a proximal end portion attached to the exterior wall and a distal end portion spaced apart from the exterior wall and attached to the cladding component, wherein each of the first and second cladding component attachment devices includes a beam extending between the proximal end portion and the distal end portion, each of the beams having a first cross-sectional shape; and at least one cladding anchor having a base attached to the exterior wall between the first and second cladding component attachment devices; and a rod having a proximal end portion attached to the base and a distal end portion spaced apart from the exterior wall and attached to the cladding component, wherein the rod has a second cross-sectional shape different than the first cross-sectional shape, wherein the at least one cladding anchor is positioned directly adjacent to the first cladding component attachment device and the second cladding component attachment device, and wherein the at least one cladding anchor is positioned equidistant from the first and second cladding component attachment devices.

20. The system of claim 19, wherein the attachment of the distal end portion of the rod to the cladding component is adjustable along the rod in an axial direction.

21. The system of claim 19, wherein the cladding component is an elongate girt arranged in a horizontal orientation or a vertical orientation with respect to the exterior wall.

22. The system of claim 19, wherein an insulation material is positioned between the exterior wall and the cladding component, and wherein the first and second cladding component attachment devices and the at least one cladding anchor extend through the insulation material.

23. The system of claim 19, wherein the rod is solid.

24. A system for attaching a cladding component to an exterior wall of a building, the system comprising:

a first cladding component attachment device having a proximal end portion attached to the exterior wall and a distal end portion spaced apart from the exterior wall and attached to the cladding component;

a second cladding component attachment device having a proximal end portion attached to the exterior wall and a distal end portion spaced apart from the exterior wall and attached to the cladding component, wherein each of the first and second cladding component attachment devices includes a beam extending between the proximal end portion and the distal end portion, each of the beams having a first cross-sectional shape; and at least one cladding anchor having a base attached to the exterior wall between the first and second cladding component attachment devices; and a rod having a proximal end portion attached to the base and a distal end portion spaced apart from the exterior wall and attached to the cladding component, wherein the rod has a second cross-sectional shape different than the first cross-sectional shape, wherein two of the at least one cladding anchors are positioned adjacent to each other between the first and second cladding component attachment devices, and wherein the first and second cladding component attachment devices and the two cladding anchors are arranged in a row.

25. The system of claim 24, wherein the row is oriented horizontally with respect to the exterior wall.

26. The system of claim 24, wherein the row is oriented vertically with e exterior wall.

27. The system of claim 24, wherein the attachments of the distal end portions of the rods of the two cladding anchors to the cladding component are adjustable along the rods in an axial direction.

28. The system of claim 24, wherein the cladding component is an elongate girt configured to operably couple a cladding material to the exterior wall.

29. The system of claim 24, wherein an insulation material is positioned between the exterior wall and the cladding component, and wherein the first and second cladding component attachment devices and the two cladding anchors extend through the insulation material.

30. A system for attaching a cladding component to an exterior wall of a building, the system comprising:

a first cladding component attachment device having a proximal end portion attached to the exterior wall and a distal end portion spaced apart from the exterior wall and attached to the cladding component;

a second cladding component attachment device having a proximal end portion attached to the exterior wall and a distal end portion spaced apart from the exterior wall and attached to the cladding component, wherein each of the first and second cladding component attachment devices includes a beam extending between the proximal end portion and the distal end portion, each of the beams having a first cross-sectional shape, and wherein each of the beams is a tubular member; and at least one cladding anchor having a base attached to the exterior wall between the first and second cladding component attachment devices; and a rod having a proximal end portion attached to the base and a distal end portion spaced apart from the exterior wall and attached to the cladding component, wherein the rod has a second cross-sectional shape different than the first cross-sectional shape.

31. The system of claim 30, wherein an insulation material is positioned between the exterior wall and the cladding component, and wherein the first and second cladding component attachment devices and the at least one cladding anchor extend through the insulation material.

32. The system of claim 30, wherein the base of the at least one cladding anchor is configured to receive a threaded portion of the proximal end portion of the rod.

33. The system of claim 30, wherein the first cross-sectional shape is a rectangular shape.

34. A system for attaching a cladding component to an exterior wall of a building, the system comprising:

a first cladding component attachment device having a proximal end portion attached to the exterior wall and a distal end portion spaced apart from the exterior wall and attached to the cladding component;

a second cladding component attachment device having a proximal end portion attached to the exterior wall and a distal end portion spaced apart from the exterior wall and attached to the cladding component, wherein each of the first and second cladding component attachment devices includes a beam extending between the proximal end portion and the distal end portion, each of the beams having a first cross-sectional shape, and wherein the first cross-sectional shape is a hollow cross-sectional shape; and at least one cladding anchor having a base attached to the exterior wall between the first and second cladding component attachment devices; and a rod having a proximal end portion attached to the base and a distal end portion spaced apart from the exterior wall and attached to the cladding component, wherein the rod has a second cross-sectional shape different than the first cross-sectional shape.

35. The system of claim 34 wherein two of the at least one cladding anchors are positioned adjacent to each other between the first and second cladding component attachment devices, and wherein the first and second cladding component attachment devices and the two cladding anchors are arranged in a row.

36. The system of claim 34, wherein the base of the at least one cladding anchor is a plate having one or more apertures configured to receive a fastener for attaching the cladding anchor to the exterior wall of the building.

37. The system of claim 34, wherein the attachment of the distal end portion of the rod to the cladding component is adjustable along the rod in an axial direction.

38. The system of claim 34, wherein the first and second cladding component attachment devices have a higher thermal transmittance between the exterior wall and the cladding component than the at least one cladding anchor.

39. The system of claim 34, wherein the base of the at least one cladding anchor is configured to receive a threaded portion of the proximal end portion of the rod.

* * * * *